US008238583B2

(12) United States Patent
Wu

(10) Patent No.: US 8,238,583 B2
(45) Date of Patent: Aug. 7, 2012

(54) MICROPHONE CIRCUIT AND METHOD FOR ANALOG-TO-DIGITAL CONVERSION THEREIN

(75) Inventor: Li-Te Wu, Taipei (TW)

(73) Assignee: Fortemedia, Inc., Sunnyvale, CA (US)

( * ) Notice: Subject to any disclaimer, the term of this patent is extended or adjusted under 35 U.S.C. 154(b) by 1287 days.

(21) Appl. No.: 11/946,076

(22) Filed: Nov. 28, 2007

(65) Prior Publication Data

US 2009/0136062 A1 May 28, 2009

(51) Int. Cl.
*H04R 3/00* (2006.01)

(52) U.S. Cl. ..... 381/122

(58) Field of Classification Search ..... 381/122
See application file for complete search history.

(56) References Cited

U.S. PATENT DOCUMENTS 6,675,125 B2 * 1/2004 Bizjak ..... 702/179
6,766,176 B1 * 7/2004 Gupta et al. ..... 455/550.1
6,904,274 B2 * 6/2005 Simmons et al. ..... 455/245.1
7,646,807 B1 * 1/2010 Manickam et al. ..... 375/232
8,064,619 B2 * 11/2011 Wu ..... 381/111
2002/0061738 A1 * 5/2002 Simmons et al. ..... 455/234.1
2002/0067838 A1 * 6/2002 Kindred et al. ..... 381/104
2002/0130696 A1 * 9/2002 Yoshizawa ..... 327/307
2003/0194981 A1 * 10/2003 Rimini et al. ..... 455/234.1
2005/0237234 A1 * 10/2005 Kobayashi et al. ..... 341/155
2006/0147061 A1 * 7/2006 Niwa et al. ..... 381/113
2006/0222118 A1 * 10/2006 Murthy et al. ..... 375/345
2007/0147639 A1 * 6/2007 Richardson et al. ..... 381/107
2007/0173730 A1 * 7/2007 Bikko ..... 600/538
2008/0187078 A1 * 8/2008 Hong et al. ..... 375/350
2009/0109078 A1 * 4/2009 Straussnigg et al. ..... 341/155

* cited by examiner

*Primary Examiner* — Kiesha Bryant
*Assistant Examiner* — Igwe U Anya
(74) *Attorney, Agent, or Firm* — Thomas|Kayden

(57) ABSTRACT

The invention provides a method for analog-to-digital conversion in a microphone circuit. First, a first gain is determined. A first analog signal is then amplified according to the first gain to obtain a second analog signal. The second analog signal is then converted from analog to digital to obtain a first digital signal. A second gain is then determined according to the first gain so that a product of the first gain and the second gain is kept constant. The first digital signal is then amplified according to the second gain to obtain a second digital signal.

19 Claims, 6 Drawing Sheets

MICROPHONE CIRCUIT AND METHOD FOR ANALOG-TO-DIGITAL CONVERSION THEREIN

BACKGROUND OF THE INVENTION

1. Field of the Invention

The invention relates to microphones, and more particularly to analog-to-digital conversion of microphone circuits.

2. Description of the Related Art

A microphone circuit converts sound pressure to an electric signal. The electric signal generated by the microphone circuit may be analog or digital. Due to popularity of digital processors, microphone circuits are required to generate electric signals of digital format to facilitate digital processing. Because a sensor of a microphone circuit directly converts sound pressure to an analog voltage signal, the analog voltage signal must therefore be converted from analog to digital as an output of the microphone circuit. Thus, an analog-to-digital converter is a requisite component of a microphone circuit.

Referring to FIG. 1, a block diagram of a conventional microphone module 100 is shown. The microphone module 100 comprises a microphone circuit 110 and a host 120. The microphone circuit 110 converts a sound signal to a digital electric signal D and delivers the digital signal D to the host 120. In one embodiment, the host 120 is a digital signal processor (DSP). The microphone circuit 110 comprises a sensor 102, a gain stage 104, and an analog-to-digital converter 106. The sensor 102 converts sound pressure to an analog electric signal $S_1$. The gain stage 104 then amplifies the analog signal $S_1$ to obtain an analog signal $S_2$ with amplitude suitable for processing in an analog-to-digital converter 106. The analog-to-digital converter 106 then converts the analog signal $S_2$ to the digital signal D as the output of the microphone module 110. The host 120 provides the analog-to-digital converter 106 with a clock signal CLK for analog-to-digital conversion.

For good quality of the digital signal D, the signal-to-noise ratio of the digital signal D must be high enough. An analog-to-digital converter with a high signal-to-noise ratio, however, requires large power consumption. When an analog-to-digital converter 106 with a lower signal-to-noise ratio and thus less power consumption is adopted, a gain value of the gain stage 104 must be carefully determined to ensure the digital output signal D a good signal-to-noise ratio. If the amplitude of the analog signal $S_1$ is small, the gain stage 104 requires a large gain value to increase the amplitude of the amplified analog signal $S_2$ as an input of the ADC 106. If the amplitude of the analog signal $S_1$ is large, the gain stage 104 requires a small gain value to prevent the ADC 106 from saturation.

The gain of the conventional gain stage 104, however, is kept constant and cannot be determined according to the amplitude of the analog signal $S_1$. If the gain stage 104 automatically adjusts the amplitude of the analog signal $S_2$, the host 120 requires information about the gain value of the gain stage 104 for signal processing such as echo cancellation. The data interface between the microphone circuit 110 and the host 120, however, has no path for transmitting information about the gain value of the gain stage 104. The gain of the conventional gain stage 104 is therefore kept constant. When the gain of the gain stage 104 is kept constant, the amplitude of the input signal $S_2$ of the analog-to-digital converter 106 can not be properly adjusted to ensure the digital output signal D a good signal-to-noise ratio. Thus, a method for analog-to-digital conversion in a microphone circuit is required.

BRIEF SUMMARY OF THE INVENTION

The invention provides a method for analog-to-digital conversion in a microphone circuit. First, a first gain is determined. A first analog signal is then amplified according to the first gain to obtain a second analog signal. The second analog signal is then converted from analog to digital to obtain a first digital signal. A second gain is then determined according to the first gain so that a product of the first gain and the second gain is kept constant. The first digital signal is then amplified according to the second gain to obtain a second digital signal.

The invention also provides a microphone circuit. In one embodiment, the microphone circuit comprises a pre-amplifier, an analog-to-digital converter, a post-amplifier, and a power estimation module. The pre-amplifier amplifies a first analog signal according to a first gain to obtain a second analog signal. The analog-to-digital converter converts the second analog signal from analog to digital to obtain a first digital signal. The post-amplifier amplifies the first digital signal according to a second gain to obtain a second digital signal. The power estimation module determines the first gain, and determines the second gain according to the first gain so that a product of the first gain and the second gain is kept constant.

The invention also provides an auxiliary circuit for analog-to-digital conversion in a microphone circuit. In one embodiment, the auxiliary circuit comprises a pre-amplifier, a post-amplifier, and a power estimation module. The pre-amplifier amplifies a first analog signal converted from sound pressure by a microphone sensor according to a first gain to obtain a second analog signal as an input of an analog-to digital converter. The post-amplifier amplifies a first digital signal output by the analog-to digital signal according to a second gain to obtain a second digital signal. The power estimation module determines the first gain, and determines the second gain according to the first gain so that a product of the first gain and the second gain is kept constant. The second analog signal is converted to the first digital signal by the analog-to-digital signal.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
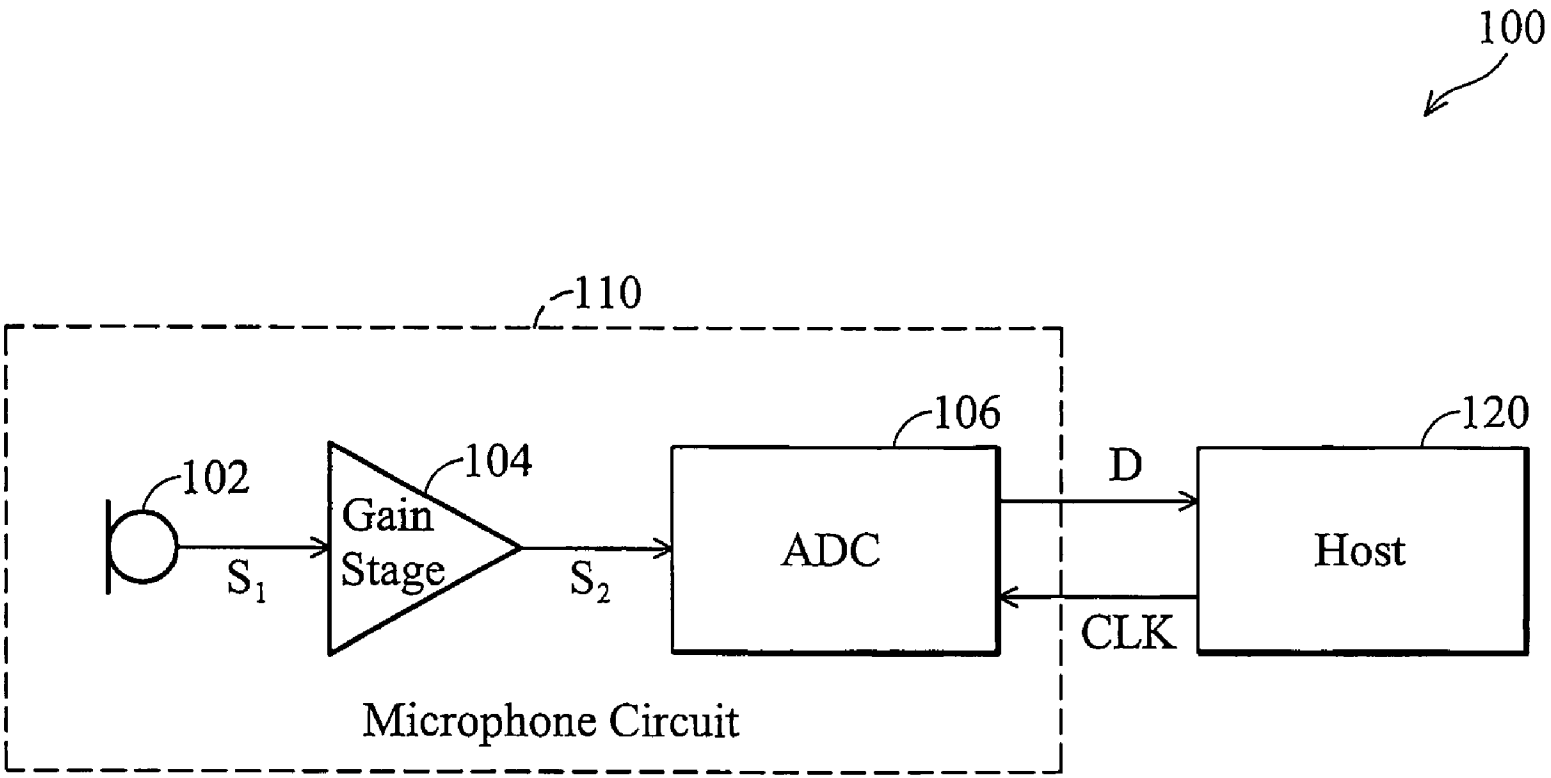
FIG. 1 ( PRIOR ART )
FIG. 1 is a block diagram of a conventional microphone module.
Figure 2:
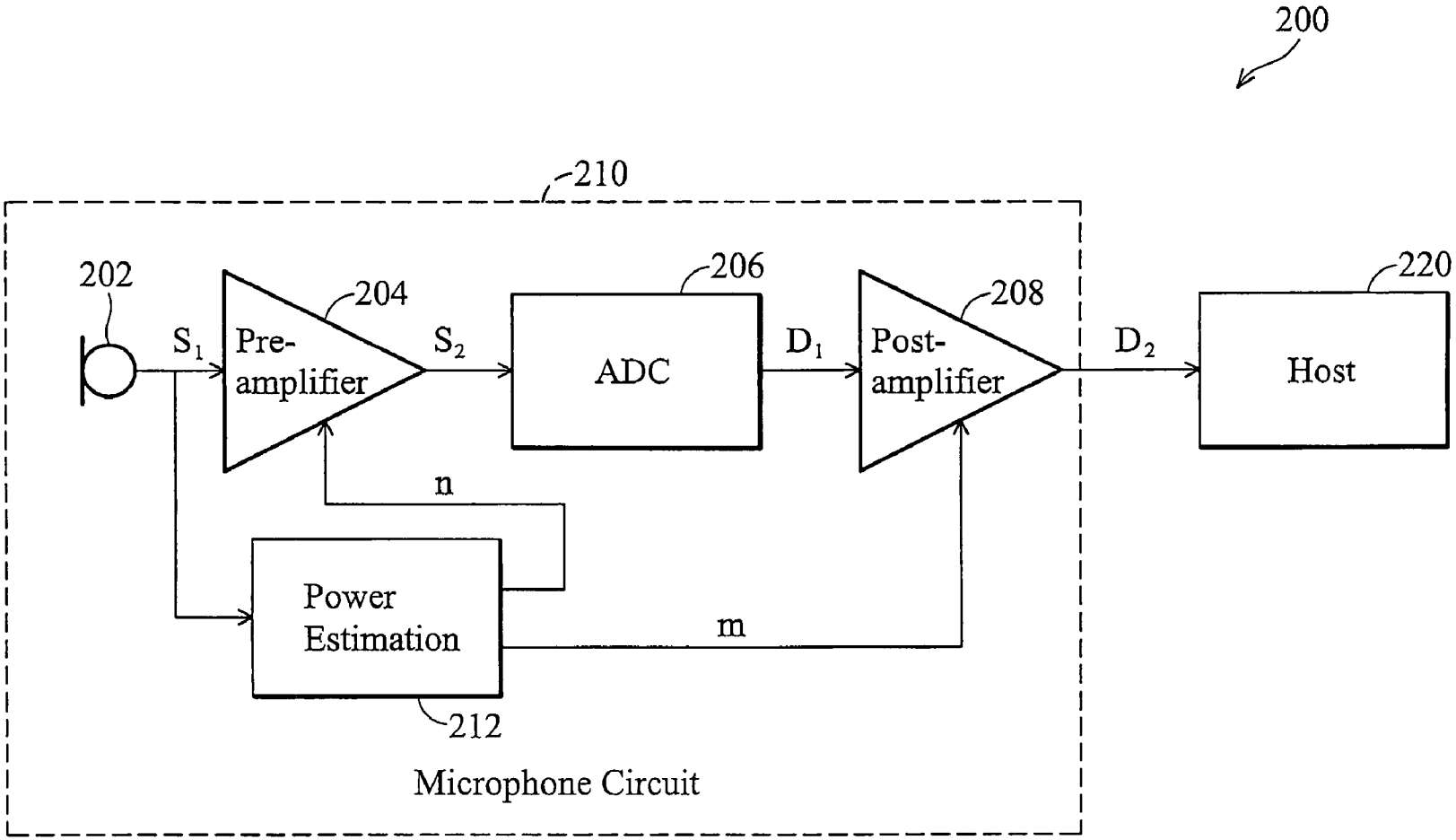
FIG. 2 is a block diagram of a microphone module according to the invention.

Referring to FIG. 2, a block diagram of a microphone module 200 according to the invention is shown. The microphone module 200 comprises a microphone circuit 210 and a host 220. The microphone circuit 210 converts a sound signal to a digital electric signal $D_2$ and delivers the digital signal $D_2$ to the host 220. In one embodiment, the host 220 is a digital signal processor (DSP). The microphone circuit 210 comprises a sensor 202, a pre-amplifier 204, an analog-to-digital converter 206, a post-amplifier 208, and a power estimation module 212. The sensor 202 first converts sound pressure to an analog electric signal $S_1$. The power estimation module 212 then determines a first gain n according to the amplitude of the analog signal $S_1$. When the amplitude of the analog signal $S_1$ is small, the power estimation module 212 increases the first gain n. When the amplitude of the analog signal $S_1$ is large, the power estimation module 212 decreases the first gain n.

The pre-amplifier 204 then amplifies the analog signal $S_1$ according to the first gain n to obtain an amplified analog signal $S_2$ as an input of the analog-to-digital converter 206. Because the amplitude of the analog signal $S_2$ is adjusted according to the amplitude of the analog signal $S_1$, the analog-to-digital converter 206 has an input signal $S_2$ with amplitude suitable for processing. The analog-to-digital converter 206 then converts the analog signal $S_2$ to the digital signal $D_1$. Because amplitude of the input signal $S_2$ is large enough, the analog-to-digital converter 206 generates the digital signal $D_1$ with a high enough signal-to-noise ratio to ensure a good signal quality. In addition, the amplitude of the input signal $S_2$ is not too large to prevent the analog-to-digital converter 206 from saturation.

Figure 3:
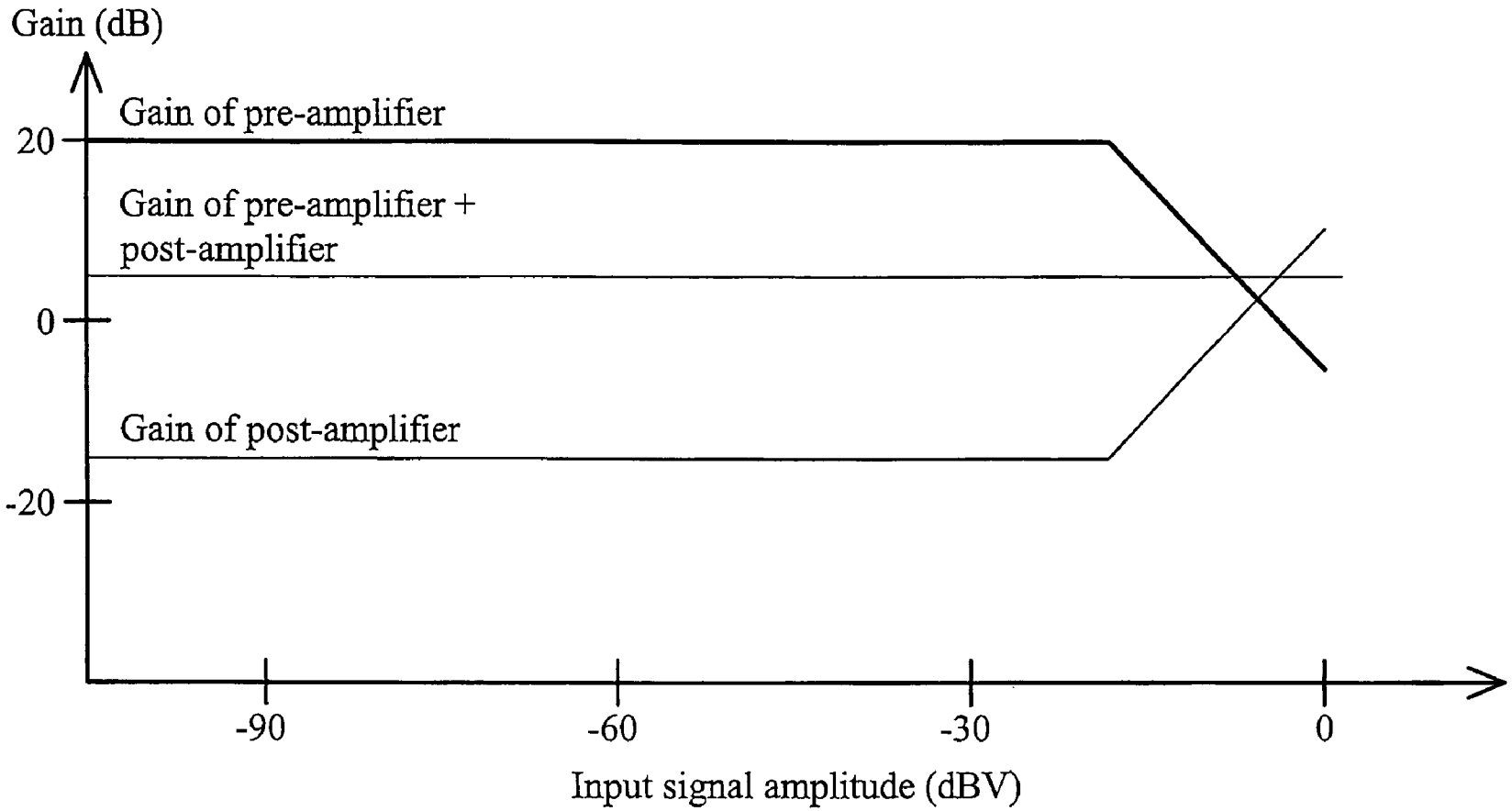
FIG. 3 shows a gain of the pre-amplifier, a gain of a post-amplifier, and a total signal gain.

The power estimation module 212 then determines a second gain m according to the first gain n. The second gain m is determined so that a product of the first gain n and the second gain m is kept constant. Thus, the second gain m is in inverse proportion to the first gain n. When the first gain n increases, the second gain m decreases. When the first gain n decreases, the second gain m increases. Referring to FIG. 3, a gain n of the pre-amplifier 204, a gain m of a post-amplifier, and a total gain equal to the product of gains m and n are shown. It can be seen that although the gain n of the pre-amplifier 204 varies with the amplitude of the analog signal $S_1$, the total gain m×n is kept constant over all amplitudes of the analog signal $S_1$. The post-amplifier 208 then amplifies the digital signal $D_1$ according to the second gain n to obtain a digital signal $D_2$. Thus, the gain of the digital signal $D_2$ in contrast with the analog signal $S_1$ is kept constant, and when the digital signal $D_2$ is output to the host 220, the host 220 requires no information about gain value of the digital signal $D_2$ for signal processing.

Figure 4:
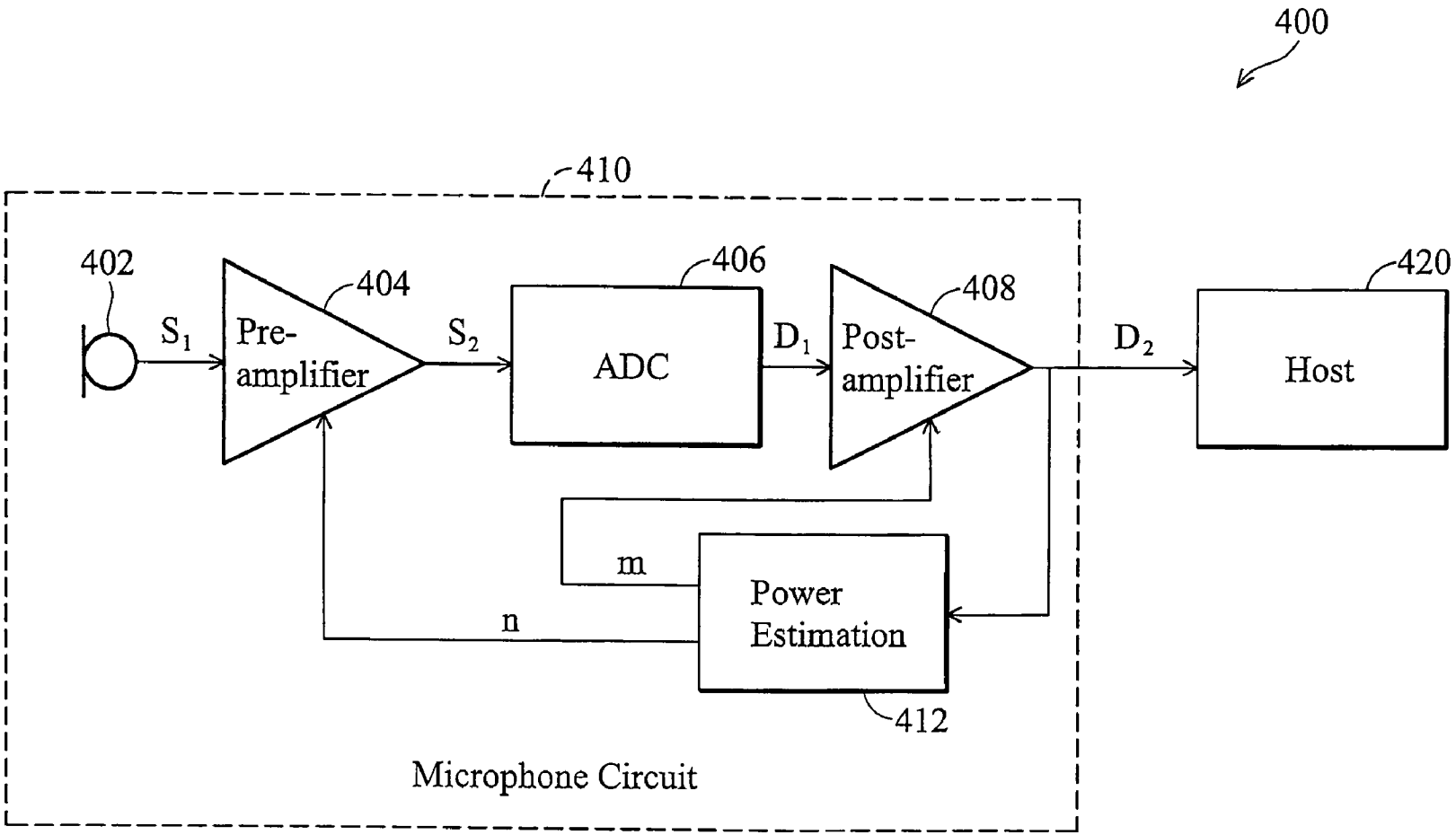
FIG. 4 is a block diagram of another embodiment of a microphone module according to the invention.

Referring to FIG. 4, a block diagram of another embodiment of a microphone module 400 according to the invention is shown. As the microphone circuit 210 of FIG. 2, the microphone circuit 410 also comprises a sensor 402, a pre-amplifier 404, an analog-to-digital converter 406, a post-amplifier 408, and a power estimation module 412. All the components of the microphone circuit 410 operate similarly to the corresponding components of the microphone circuit 210 except for the power estimation module 412. The power estimation module 412 first determines the first gain n of the pre-amplifier 404 according to the digital signal $D_2$ instead of the analog signal $S_1$, and then determines the second gain m according to the first gain n so that a product of the first gain and the second gain is kept constant. In another embodiment, the power estimation module 412 can also determine the first gain n of the pre-amplifier 404 according to the analog signal $S_2$ or the digital signal $D_1$ instead of the analog signal $S_1$ or the digital signal $D_2$. Thus, the microphone circuit 410 has the same advantage as the microphone circuit 210 of FIG. 2.

Figure 5:
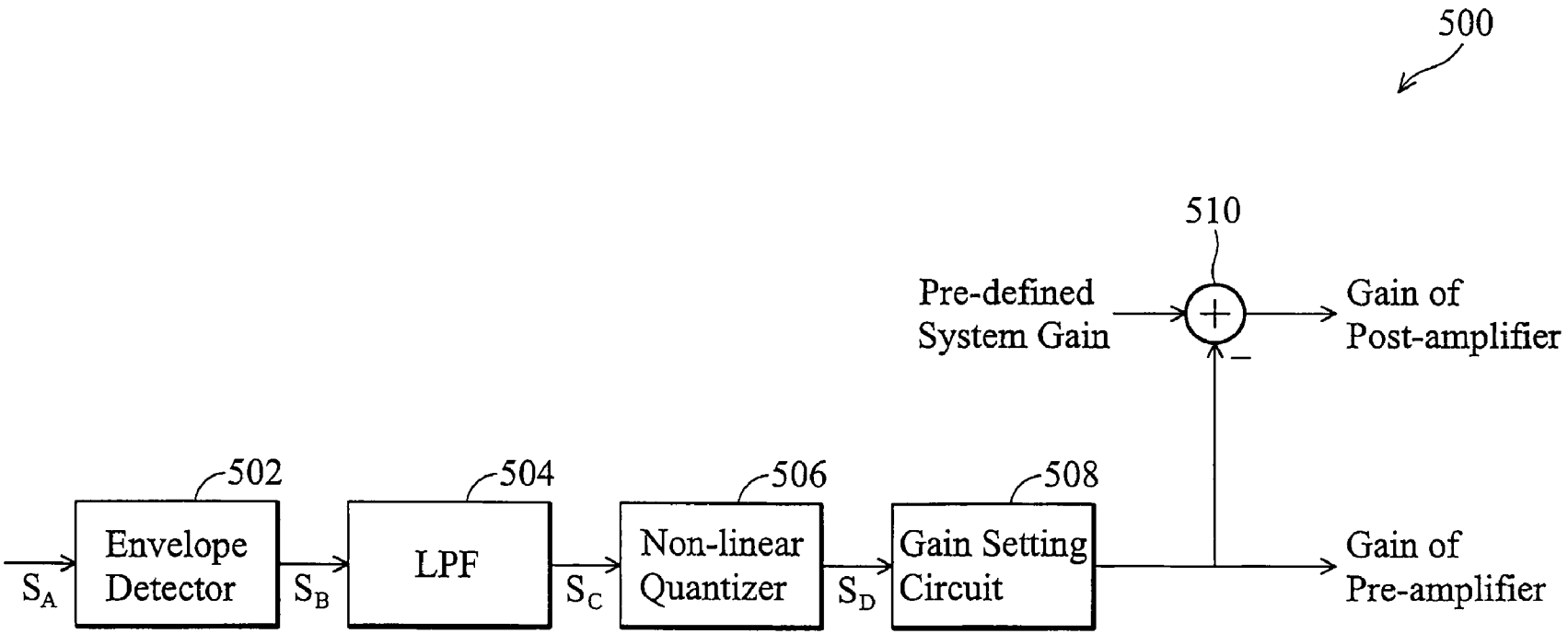
FIG. 5 is a block diagram of a power estimation module according to the invention.
Figure 6:
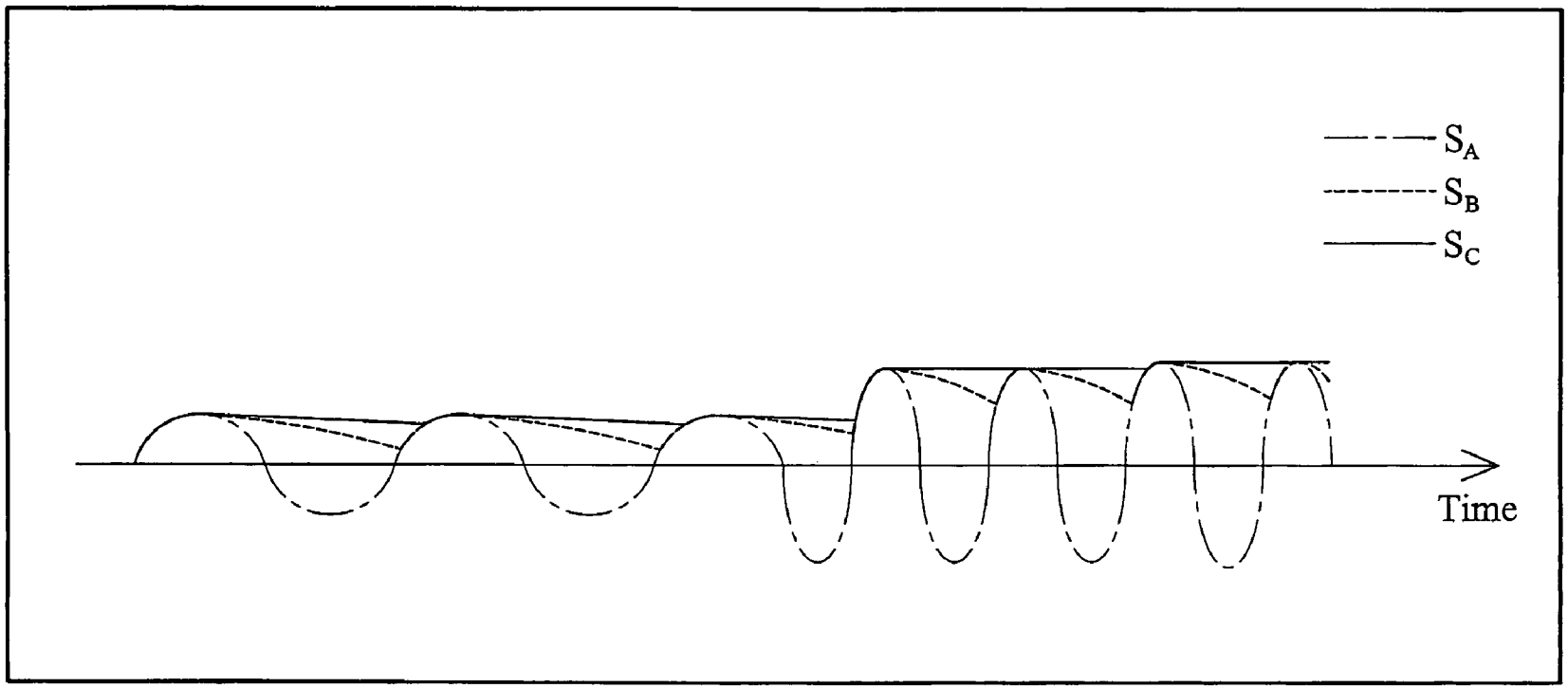
FIG. 6 is a schematic diagram of an input signal, an envelope signal, and a filtered signal of a power estimation module of FIG. 5.

Referring to FIG. 5, a block diagram of a power estimation module 500 according to then invention is shown. The power estimation module 500 comprises an envelope detector 502, a low pass filter 504, a non-linear quantizer 506, a gain setting circuit 508, and an adder 510. The envelope detector 502 first detects an envelope of an input signal $S_A$ of the power estimation module 500 to obtain an envelope signal $S_B$. The power estimation module 500 may take the analog signal $S_1$, the analog signal $S_2$, the digital signal $D_1$, or the digital signal $D_2$ as the input signal $S_A$. The low pass filter 504 then filters the envelope signal $S_B$ to obtain a filtered signal $S_C$. Referring to FIG. 6, a schematic diagram of the input signal $S_A$, the envelope signal $S_B$, and the filtered signal $S_C$ of the power estimation module 500 is shown.

The non-linear quantizer 506 then converts the filtered signal $S_C$ from analog to digital to obtain a digital signal $S_D$. The gain setting circuit 508 then determines the first gain n of the pre-amplifier according to the digital signal $S_D$. The adder 510 then subtracts a decibel value of the first gain n from a predetermined constant to obtain a decibel value of the second gain m of the post-amplifier. Because sum of the decibel values of the gains n and m is equal to the predetermined constant, a product of the gains n and m of the pre-amplifier and the post-amplifier is kept constant.

The invention provides a method for analog-to-digital conversion in a microphone circuit. The microphone circuit comprises a pre-amplifier, a post-amplifier, and a power estimation module. The pre-amplifier amplifies an analog signal according to a first gain to obtain an amplified analog signal as an input of an analog-to digital converter. The post-amplifier amplifies a digital signal output by the analog-to digital signal according to a second gain to obtain an amplified digital signal as an output signal of the microphone circuit. The power estimation module determines the first gain, and determines the second gain according to the first gain so that a product of the first gain and the second gain is kept constant. Thus, the amplitude of the input of the analog-to-digital converter is large enough to ensure a digital output signal a high signal-to-noise ratio while the gain of the output signal of the microphone circuit is kept constant.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method for analog-to-digital conversion in a microphone circuit, comprising:

determining a first gain;

amplifying a first analog signal according to the first gain to obtain a second analog signal;

converting the second analog signal from analog to digital to obtain a first digital signal;

determining a second gain according to the first gain so that a product of the first gain and the second gain is kept constant; and amplifying the first digital signal according to the second gain to obtain a second digital signal;

wherein the determination of the first gain comprises:

detecting an envelope of the first analog signal to obtain an envelope signal;

filtering the envelope signal with a low pass filter to obtain a filtered signal;

converting the filtered signal from analog to digital to obtain a third digital signal; and determining the first gain according to the third digital signal.

2. The method as claimed in claim 1, wherein the first analog signal is converted from sound pressure by a microphone sensor of the microphone circuit.

3. The method as claimed in claim 1, wherein the first gain is determined according to the first analog signal.

4. The method as claimed in claim 3, wherein the method further comprises determining the first gain, and the determination of the first gain comprises:

when an amplitude of the first analog signal is large, decreasing the first gain; and when the amplitude of the first analog signal is small, increasing the first gain.

5. The method as claimed in claim 1, wherein the first gain is determined according to the second digital signal, the second analog signal, or the first digital signal.

6. The method as claimed in claim 1, wherein the determination of the second gain comprises subtracting a decibel value of the first gain from a predetermined constant to obtain a decibel value of the second gain.

7. A microphone circuit, comprising:

a pre-amplifier, amplifying a first analog signal according to a first gain to obtain a second analog signal;

an analog-to-digital converter, coupled to the pre-amplifier, converting the second analog signal from analog to digital to obtain a first digital signal;

a post-amplifier, coupled to the analog-to-digital converter, amplifying the first digital signal according to a second gain to obtain a second digital signal; and a power estimation module, coupled to the pre-amplifier and the post-amplifier, determining the first gain, and determining the second gain according to the first gain so that a product of the first gain and the second gain is kept constant.

8. The microphone circuit as claimed in claim 7, wherein the first analog signal is converted from sound pressure by a microphone sensor of the microphone circuit.

9. The microphone circuit as claimed in claim 7, wherein the power estimation module determines the first gain according to the first analog signal.

10. The microphone circuit as claimed in claim 9, wherein when amplitude of the first analog signal is large, the power estimation module decreases the first gain, and when amplitude of the first analog signal is small, the power estimation module increases the first gain, thus the first gain is determined.

11. The microphone circuit as claimed in claim 7, wherein the power estimation module determines the first gain according to the second digital signal, the second analog signal, or the first digital signal.

12. The microphone circuit as claimed in claim 7, wherein the power estimation module comprises:

an envelope detector, detecting an envelope of the first analog signal to obtain an envelope signal;

a low pass filter, filtering the envelope signal to obtain a filtered signal;

a non-linear quantizer, converting the filtered signal from analog to digital to obtain a third digital signal; and a gain setting circuit, determining the first gain according to the third digital signal.

13. The microphone circuit as claimed in claim 12, wherein power estimation module further comprises an adder, subtracting a decibel value of the first gain from a predetermined constant to obtain a decibel value of the second gain.

14. An auxiliary circuit for analog-to-digital conversion in a microphone circuit, comprising:

a pre-amplifier, amplifying a first analog signal converted from sound pressure by a microphone sensor according to a first gain to obtain a second analog signal as an input of an analog-to digital converter;

a post-amplifier, amplifying a first digital signal output by the analog-to-digital converter according to a second gain to obtain a second digital signal; and a power estimation module, coupled to the pre-amplifier and the post-amplifier, determining the first gain, and determining the second gain according to the first gain so that a product of the first gain and the second gain is kept constant;

wherein the second analog signal is converted to the first digital signal by the analog-to-digital converter.

15. The auxiliary circuit as claimed in claim 14, wherein the power estimation module determines the first gain according to the first analog signal.

16. The auxiliary circuit as claimed in claim 15, wherein when amplitude of the first analog signal is large, the power estimation module decreases the first gain, and when amplitude of the first analog signal is small, the power estimation module increases the first gain, thus the first gain is determined.

17. The auxiliary circuit as claimed in claim 14, wherein the power estimation module determines the first gain according to the second digital signal, the second analog signal, or the first digital signal.

18. The auxiliary circuit as claimed in claim 14, wherein the power estimation module comprises:

an envelope detector, detecting an envelope of the first analog signal to obtain an envelope signal;

a low pass filter, filtering the envelope signal to obtain a filtered signal;

a non-linear quantizer, converting the filtered signal from analog to digital to obtain a third digital signal; and a gain setting circuit, determining the first gain according to the third digital signal.

19. The auxiliary circuit as claimed in claim 18, wherein power estimation module further comprises an adder, subtracting a decibel value of the first gain from a predetermined constant to obtain a decibel value of the second gain.

* * * * *